United States Patent [19]

Raymond

[11] 4,124,910

[45] Nov. 14, 1978

[54] FOLDABLE DINGHIES

[75] Inventor: Jean-Francois Raymond, London, England

[73] Assignee: Vango (Scotland) Limited, Glasgow, Scotland; a part interest

[21] Appl. No.: 835,870

[22] Filed: Sep. 23, 1977

[51] Int. Cl.[2] ..... B63B 7/00

[52] U.S. Cl. ..... 9/2 C; 9/2 F

[58] Field of Search ..... 9/2 R, 2 C, 2 S, 2 F, 9/2 A; 114/77 R, 77 A

[56] References Cited

U.S. PATENT DOCUMENTS

| | | | |
|---|---|---|---|
| 1,359,806 | 11/1920 | Holmstrom | 9/2 C |
| 1,614,280 | 1/1927 | Churchill | 9/2 C |
| 1,738,221 | 12/1929 | Bair et al. | 9/2 C |
| 2,183,137 | 12/1939 | Fischer | 9/2 C |
| 2,545,084 | 3/1951 | Harasty | 9/2 C |
| 3,070,816 | 1/1963 | Lewis | 9/2 C |
| 3,071,785 | 1/1963 | Holt | 9/2 C |

*Primary Examiner*—Trygve M. Blix
*Assistant Examiner*—Jesus D. Sotelo
*Attorney, Agent, or Firm*—Roylance, Abrams, Berdo & Farley

[57] ABSTRACT

A foldable dinghy comprises a frame and a covering of flexible waterproof material. To fold up the dinghy the frame is foldable transversely and then longitudinally for the purpose of storing and transporting the dinghy.

17 Claims, 13 Drawing Figures

FOLDABLE DINGHIES

BACKGROUND OF THE INVENTION

1. Field of the Invention

This invention relates to foldable dinghies.

2. Prior Art

Sailing and motor driven cruisers often require a dinghy, e.g. a dinghy which is maneuvered by oars or paddles, for the purpose of transporting a person or persons and baggage between the cruiser and the shore. It is known to provide such a dinghy which, during use of the cruiser, is towed behind the cruiser.

However, in the case of small cruisers, it is undesirable to have to tow a dinghy because of its drag created on the cruiser. There is thus the need for a foldable dinghy which when not required may be readily compacted and stored in a small space.

Such dinghies may also, of course, be used on their own without a sailing or motor driven cruiser for example by anglers or as a boat on its own. The invention thus relates to foldable dinghies in general.

SUMMARY

According to the invention a foldable dinghy comprises a frame and a covering of flexible waterproof material therefor, the frame being foldable both transversely and longitudinally for the purpose of storing and transporting the dinghy.

Preferably the frame comprises a plurality of members which when the dinghy is erected extend longitudinally of the dinghy and which are foldable longitudinally of the dinghy, at least one further foldable member which when the dinghy is erected extends transversely of the dinghy intermediate the ends of the dinghy and means for maintaining the dinghy erected, said means being releasable to allow the foldable transverse member or members to be folded thereby drawing the longitudinal members and the convering towards the central longitudinal axis of the dinghy whereafter the foldable longitudinal members may be folded longitudinally.

It is also preferred that the, or each, foldable transverse member comprises two or more sections which together form a seat when the dinghy is erected. Preferably one or more of the seat sections is formed of buoyancy material, for example self-skinning rigid polyurethane.

In one embodiment of the invention there are five said foldable longitudinal members, and the, or each, foldable transverse member extends between the two next to outermost longitudinal members.

Preferably the means for maintaining the dinghy erected are further members pivotally attached to respective ends of the or each foldable transverse member, each member being capable of movement between an inoperative or folded position and an operative position in which it is locked relative to the adjacent outermost longitudinal member.

There may also be provided a pair of strengthening struts at each end of the dinghy, each of which struts is pivotally attached to the central longitudinal member and releasably engageable with one of the outermost longitudinal members.

In another embodiment of the invention there are five said foldable longitudinal members, and the or each foldable transverse member extends between the two outermost longitudinal members.

The or each foldable transverse member may be supported on struts, each strut extending between and being pivotally attached to the transverse member and a respective intermediate longitudinal member.

Preferably the means for maintaining the dinghy extended are foldable members, capable of maintaining the or each foldable transverse member extended and in fixed relation relative to the central longitudinal member and thereby each longitudinal member in its respective erected position.

If desired there may be two said foldable transverse members spaced apart longitudinally of the dinghy, at least those portions of the longitudinal members which extend between each transverse member and the adjacent end of the dinghy being foldable longitudinally of the dinghy.

Preferably the covering is attached to the frame in a manner which allows the frame to be folded and unfolded without removal of the covering. A suitable material for the covering is a nylon woven fabric coated with polyvinyl chloride.

A suspended seat of flexible material may be provided adjacent one or both ends of the dinghy.

The dinghy preferably has rowlocks positioned to allow the dinghy to be rowed. It is also preferred that the central uppermost portion of the frame at the stern of the dinghy is capable of supporting an outboard motor.

The dinghy may be provided in combination with a case for storage of the dinghy when folded, which case may be a soft or hard case.

DESCRIPTION OF THE PREFERRED EMBODIMENTS

Each embodiment is of a foldable rowing dinghy for use with a sailing or motor driven cruiser, the dinghy being foldable for storage or transport, for example in a locker on the cruiser or in the boot or trunk of a car. When erected, the dinghy may be used to transport persons and/or baggage between the cruiser and the shore. However, it is to be appreciated that the dinghy may also be used on its own, merely as a foldable rowing dinghy.

Figure 3:
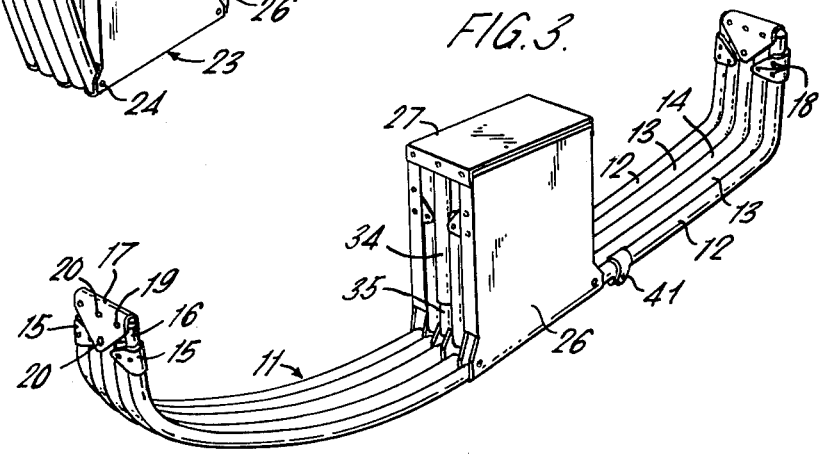
FIG. 3 shows the dinghy of FIG. 1 with the transverse member fully folded, the outer covering being omitted.
Figure 5:
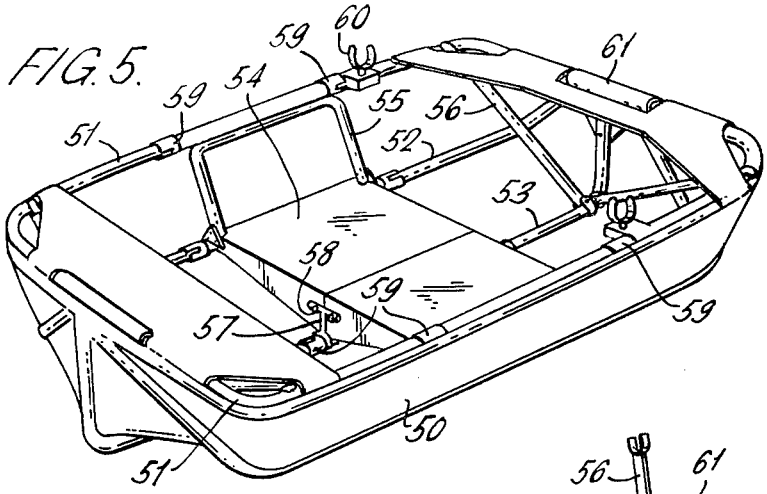
FIG. 5 is a perspective view of another foldable dinghy.

Referring to FIGS. 1 to 4, a foldable dinghy comprises an outer covering 10 and a frame having five tubular members 11 which extend longitudinally of the dinghy when it is erected. The ends of the longitudinal members are connected together at both the bow and the stern of the dinghy so that the outermost longitudinal members 12 and the two outer intermediate longitudinal members 13 may be folded inwardly of the dinghy to lie adjacent the central longitudinal member 14, all the longitudinal members being in line transversely of the dinghy (FIG. 3). To achieve this, on each side of the dinghy the members 12 and 13 are pivotally interconnected by brackets 15 to which the members are attached by rivets 18. Also, each bracket 15 has an extension 16 of the outermost longitudinal member 12 which is pivotally connected by a rivet 19 to a bracket 17 attached by two rivets 20 to the respective ends of the central longitudinal member 14. When the longitudinal members 12, 13 are folded inwardly of the dinghy the hinge points of the dinghy are in line longitudinally of the dinghy.

Figure 1:
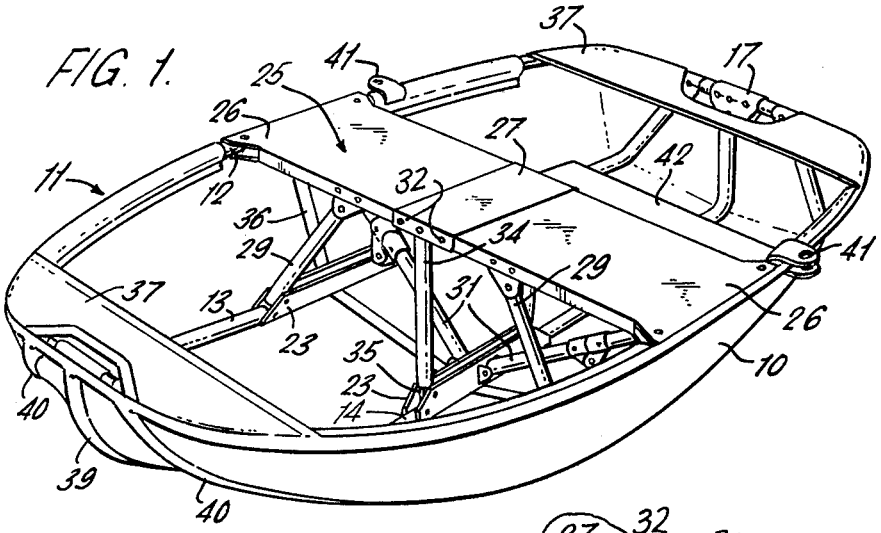
FIG. 1 is a perspective view, by way of example, of a foldable dinghy.
Figure 2:
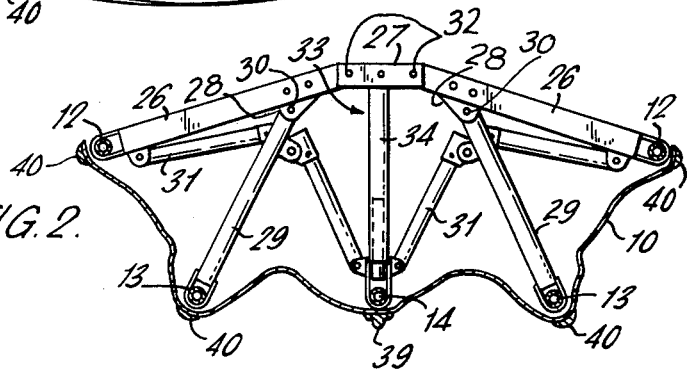
FIG. 2 is a transverse section through the dinghy of FIG. 1 showing the first step in folding the dinghy.
Figure 4:
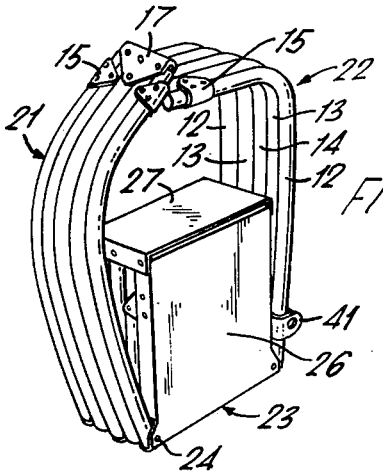
FIG. 4 shows the dinghy of FIG. 1 fully folded, the outer covering again being omitted.

In order to further compact the dinghy when folded, each longitudinal member 11 is formed of two end portions 21, 22 interconnected by a channel-shaped intermediate portion 23 to which the end portions are pivotally attached by rivets 24. The members may thereby be folded end to end (FIG. 4). In this embodiment the end portions 21 are longer than their respective end portions 22 so that when the members 11 are folded end to end the end portions overlap.

The dinghy also comprises a foldable member which when the dinghy is erected extends transversely of the dinghy. This foldable transverse member comprises a seat 25 having two end portions 26 which are pivotally attached by rivets 32 to a central portion 27. The free ends of the end portions 26 comprise the intermediate portions 23 of the outermost longitudinal members 12. Attached to the underside of the end portions 26 are brackets 28 to which respective pairs of struts 29 are pivotally attached by rivets 30. Each pair of struts 29 is also connected to the intermediate portion 23 of the respective outer intermediate longitudinal member 13. Further foldable struts 31 interconnect the intermediate portions 23 of the outermost longitudinal members 12 and the intermediate portion of the central longitudinal member 14. When extended these structs 31 maintain the seat 25 extended and thereby the dinghy erected.

To support the central portion 27 of the seat 25 there are provided a pair of vertical telescopic struts 33, the upper portion 34 of each strut 33 being attached to the underside of the central portion 27 and the lower portion 35 being attached to the intermediate portion 23 of the central longitudinal member 14. The purpose of the struts 33 being telescopic is to allow the struts to extend during the folding of the longitudinal members longitudinally of the dinghy and to contract during the unfolding of the longitudinal members.

In this embodiment the seat 25 is formed of inverted channel-shaped metal members 26, 27. However, if desired the seat portion may be formed from a tubular frame to which a seat of flexible material is attached.

The upper edges of the outer covering 10 are attached, e.g. by welding, to the outermost longitudinal members 12. Also the internal surface of the covering 10 has a central transverse web 36 which is attached by rivets to the intermediate portions 23 of all the longitudinal members 11, and thereby locates the covering positively with respect to the longitudinal members. The ends of the outer covering 10 have flap portions 37 and are attached to the brackets 17 of the frame by extensible members (not shown). These extensible members allow a limited amount of relative longitudinal movement between the outer covering 10 and the longitudinal members 13, 14 during the end-to-end folding step of the longitudinal members to avoid chafing of the outer covering at the points of connection of the end portions of the longitudinal members 11 and their intermediate portions.

Attached to the outer surface of the outer covering 10 is a central keel 39 and rubbing strakes 40, the keel and rubbing strakes being formed of extruded polyvinyl chloride and being of conventional design.

On either side of the keel 39 the outer covering of the dinghy defines a concave flare, when the dinghy is erected, which is achieved by the nature of the material from which the covering is formed.

A pair of sockets 41 for rowlocks (not shown) are provided to enable the dinghy to be rowed. Alternatively the rowlocks may comprise sockets having a rubber patch which is attached by adhesive to the outer covering.

The dinghy is also provided with a partial floor 42, e.g. of wood, extending between the seat 25 and the stern of the dinghy on which a person or persons may stand. In this embodiment the floor is removably attached to the longitudinal members 13, 14 by clips (not shown).

Between the seat 25 and the bow of the dinghy there may be provided a net (not shown) to contain baggage.

As described above, it is intended that the dinghy may be folded and stored, when on a motor or sailing cruiser, in a locker on the cruiser, and, when ashore, in the boot of a car. The dinghy may then be removed from the drawer on the cruiser or the boot of the car and erected in three basic movements. The first movement is to unfold the end portions of the members 11 longitudinally of the dinghy. The second movement is to unfold the longitudinal members 13, 14 outwardly whereby the seat 25 is extended and the foldable struts 31 become partially extended. The third movement is to fully extend the foldable struts 31. The dinghy is thereby erected.

To fold up the dinghy the three movements are performed in the reverse order.

If desired, the floor 42 may be a folding floor which respectively folds and unfolds as the longitudinal members 11 are folded and unfolded relative to the longitudinal axis of the dinghy, i.e., the axis of the central longitudinal member 14.

It is intended that the rowing dinghy described above is manoeuvred by oars using the rowlocks. However, it is equally possible for the dinghy to be manoeuvred by paddles.

It is further envisaged that the dinghy may be provided with an outboard motor which is removably attached to the stern of the dinghy after the dinghy has been erected.

FIGS. 5 to 8 show another foldable dinghy which is essentially the same as the embodiment described above in that it comprises an outer covering 50 and a frame having five longitudinal members 51, 52, 53 provided with pivot points 59 so that they are foldable longitudinally of the dinghy, a seat 54 extending between the next to outermost longitudinal members 52 and foldable transversely of the dinghy, and U-shaped members 55 pivotally attached to respective ends of the seat 54 for movement between inoperative positions (FIG. 6) and operative positions (FIG. 5) in which they engage underneath the outermost longitudinal members 51 and maintain the dinghy erected.

Further strengthening struts 56 are provided at each end of the dinghy, the struts being pivotally attached to the central longitudinal member 53 and having fork ends for engagement with the outermost longitudinal members 51.

The outer covering, in this embodiment, is a nylon woven fabric coated with polyvinyl chloride, but may comprise any waterproof material.

The seat 54 comprises two portions hinged together, each portion being formed of a buoyant material which in this embodiment is self-skinning rigid polyurethane. The seat also has an anti-slip surface. The seat portions may be solid or vacuum or blow moulded and then filled with foamed polystyrene. A further arrangement is for each seat portion to be formed as a hollow member without a base which is then filled with a block or polystyrene.

Extensible handles 57 are provided to engage with clips 58 on the seat portions to assist in retaining the seat portions in their erected position.

It will be appreciated that since the seat 54 extends between the next to outermost longitudinal members 52 (instead of between the outermost longitudinal members which is the case in the previously described embodiment of FIGS. 1 to 4), the dinghy of this embodiment has a lower centre of gravity and is thus more stable in use.

Figure 6:
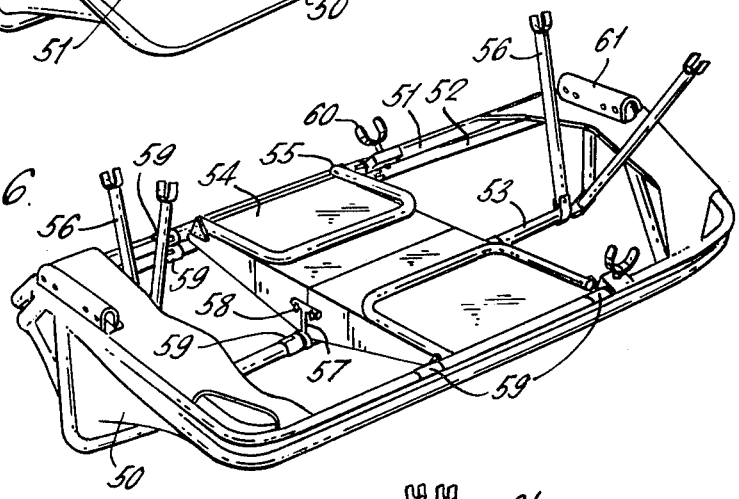
FIG. 6 shows the dinghy of FIG. 5 after the means for maintaining the dinghy erected have been released.
Figure 7:
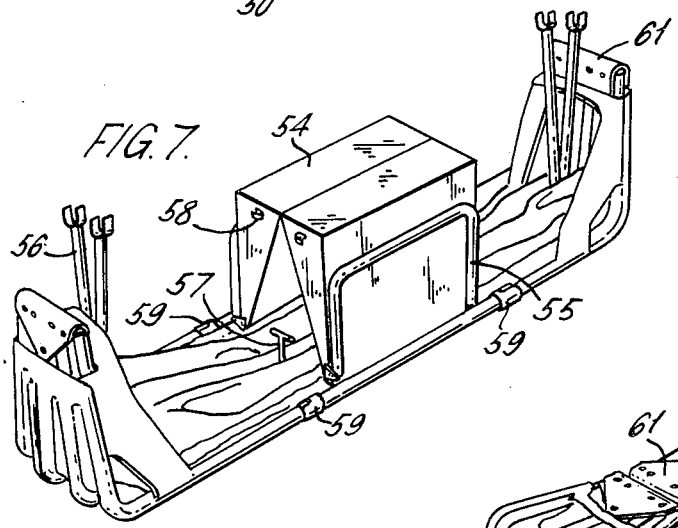
FIG. 7 shows the dinghy of FIG. 5 with the transverse member fully folded.
Figure 8:
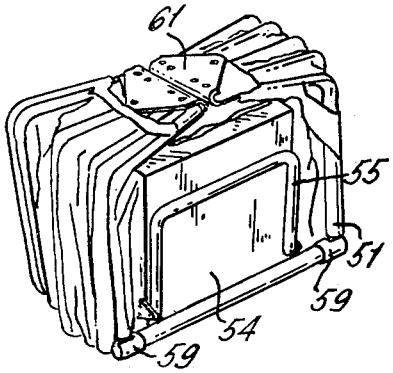
FIG. 8 shows the dinghy of FIG. 5 fully folded.

The method of folding the dinghy is clear from FIGS. 6 to 8. Firstly the strengthening struts 56 at each end of the dinghy are disengaged from the outermost longitudinal members 51. Next the central U-shaped members 55 which maintain the dinghy erect are folded inwardly onto the seat 54 (see FIG. 6). The handles 57 are then released from the clips 58 and the seat 54 is folded transversely of the dinghy whereby the next to outermost and outermost longitudinal members 52, 51 respectively are drawn towards the central longitudinal member 53 (see FIG. 7). Finally, the longitudinal members 51, 52, 53 are folded longitudinally of the dinghy whereupon the dinghy is fully folded (see FIG. 8). The dinghy thereby forms a compact package which it is possible to store in a locker on a cruiser or to transport in the boot of a car.

To unfold the dinghy the above steps are performed in the reverse order.

Rowlocks 60 are provided so that the dinghy may be rowed. Alternatively, the bracket 61 provided at the stern of the dinghy for attachment of the longitudinal members 51, 52, 53 together is formed of sufficient strength to support an outboard motor.

Figure 9:
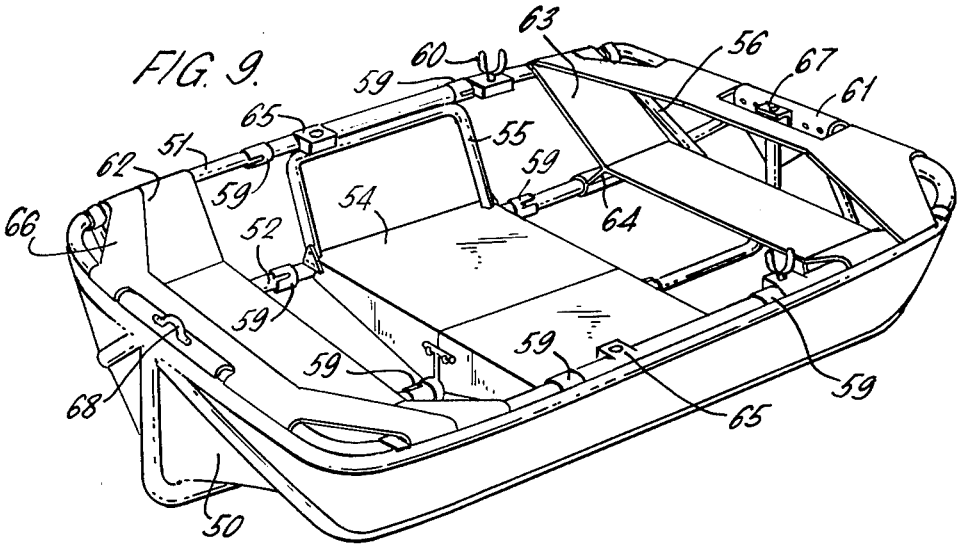
FIG. 9 is a perspective view of a further foldable dinghy.

FIG. 9 shows the dinghy of FIGS. 5 to 8 together with some accessories. The principal accessories are suspended seats 62, 63 at the ends of the dinghy. Each seat is formed from a strip of flexible material, preferably ventilated material, attached at each end to the outer covering to avoid interference of the engagement and disengagement of the struts 56 with the outermost longitudinal members 51. Extensible cords 64 are provided to hold each seat reasonably firmly. With a passenger seated on the rear seat 63 it is more convenient for the dinghy to be rowed from the front seat 62 than from the main seat 54. For this purpose additional mountings 65 are provided in the rowlocks 60. It will also be appreciated that the top flap 66 of the outer covering 50 at the bow of the dinghy is cut back to allow for the seat 62 to be fitted.

A further mounting 67 for one of the rowlocks 60 is provided at the stern of the boat so that the dinghy may be readily sculled. This mounting 67 does not interfere with the attachment of an outboard motor to the bracket 61.

An eye 68 is also provided at the bow of the dinghy for attachment of a painter.

Figure 10:
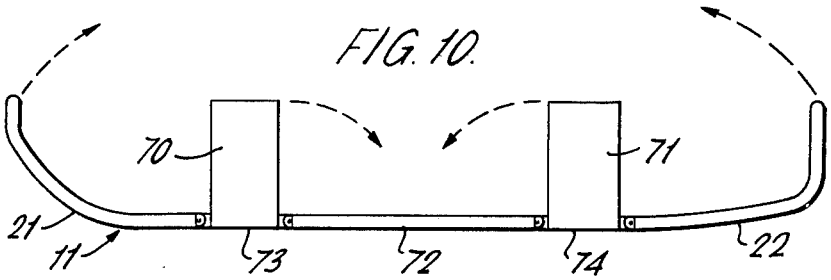
FIG. 10 is a diagrammatic view of the dinghy of FIG. 1 modified to have two foldable transverse members.

In a further modified embodiment the dinghy of FIGS. 1 to 4 may be provided with two or more seat portions spaced apart longitudinally of the dinghy. An example of such a modified dinghy having two such seats 70, 71 is shown in FIG. 10, each seat and its supports being equivalent to the seat 25 and its supports as shown in FIGS. 1 to 4. The longitudinal members 11 are also substantially the same except that the end portions 21, 22 are indirectly attached to intermediate portions 72 by respective connecting members 73, 74.

When folding the dinghy the folding struts of each seat 70, 71 are released and the longitudinal members are folded towards the longitudinal axis of the dinghy. The longitudinal members 11 are then folded longitudinally so that the seats are collapsed towards each other and the end portions 21, 22 of the longitudinal members overlap each other and overlie the intermediate portions 72 of the longitudinal members.

Figure 11:
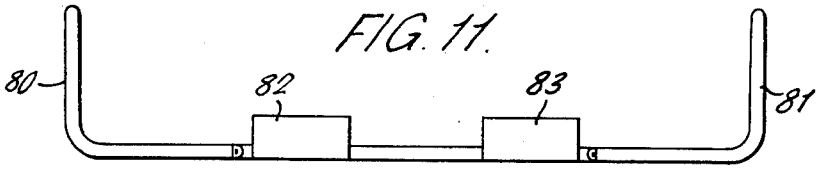
FIGS. 11 to 13 are diagrammatic views of the dinghy of FIG. 5 modified to have two foldable transverse members, the Figures showing the dinghy fully erected, partially folded and fully folded.
Figure 12:
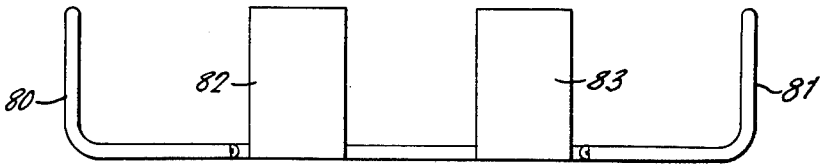
Figure 13:
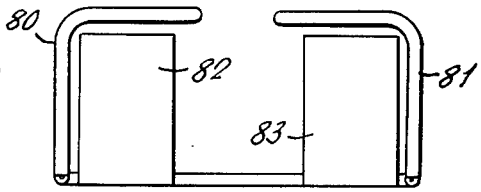

FIGS. 11 to 13 show an equivalent modification of the dinghy shown in FIGS. 5 to 8. In this case, when the longitudinal end portions 80, 81 are folded inwardly (FIG. 13), the seats 82, 83 remain upright in their transversely folded positions shown in FIG. 12.

We claim:

1. A foldable dinghy comprising a frame and a covering of flexible waterproof material therefor, the frame being foldable both transversely and longitudinally for the purpose of storing and transporting the dinghy, wherein the frame comprises a plurality of longitudinally foldable members which, when the dinghy is erected, extend longitudinally of the dinghy, each of said longitudinal members having two hinge means therein defining a central portion and two end portions with the end portions being foldable toward each other about transverse axes through said hinge means;

at least one transverse foldable member which, when the dinghy is erected, extends transversely of the dinghy intermediate the ends of the dinghy, and means for maintaining the dinghy erected, said means being releasable to allow said at least one foldable transverse member to be folded, thereby drawing the longitudinal members into parallel contiguous relationship along the central longitudinal axis of the dinghy with the axes of said hinge means substantially aligned so that the foldable longitudinal members may be folded longitudinally.

2. A foldable dinghy as claimed in claim 1, wherein said foldable transverse member comprises at least two sections hingedly connected together to form a seat when the dinghy is erected.

3. A foldable dinghy as claimed in claim 2, wherein the dinghy has rowlocks positioned to allow the dinghy to be rowed.

4. A foldable dinghy as claimed in claim 2, wherein at least one of the seat sections is formed of buoyancy material.

5. A foldable dinghy as claimed in claim 4, wherein the buoyancy material is self-skinning rigid polyurethane.

6. A foldable dinghy as claimed in claim 1, wherein these are five said foldable longitudinal members, and the foldable transverse member extends between the two next to outermost longitudinal members.

7. A foldable dinghy as claimed in claim 6, wherein the means for maintaining the dinghy erected includes strut members pivotally attached to respective ends of said foldable transverse member, each strut member being movable between an inoperative folded position and an operative position in which it is locked relative to the adjacent outermost longitudinal member.

8. A foldable dinghy as claimed in claim 7, and further comprising a pair of strengthening struts at each end of the dinghy, each of which struts is pivotally attached to the central longitudinal member and releasably engageable with one of the outermost longitudinal members.

9. A foldable dinghy as claimed in claim 1, wherein there are five said foldable longitudinal members, and the foldable transverse member extends between the two outermost longitudinal members.

10. A foldable dinghy as claimed in claim 9, wherein the foldable transverse member is supported on struts, each strut extending between and being pivotally attached to the transverse member and a respective intermediate longitudinal member.

11. A foldable dinghy as claimed in claim 9, wherein the means for maintaining the dinghy extended comprises foldable members capable of maintaining the foldable transverse member extended and in fixed relation relative to the central longitudinal member, thereby maintaining each longitudinal member in its respective erected position.

12. A foldable dinghy as claimed in claim 1, wherein there are two said foldable transverse members spaced apart longitudinally of the dinghy, at least those portions of the longitudinal members which extend between each transverse member and the adjacent end of the dinghy being foldable longitudinally of the dinghy.

13. A foldable dinghy as claimed in claim 1, wherein the covering is attached to the frame in a manner which allows the frame to be folded and unfolded without removal of the covering.

14. A foldable dinghy as claimed in claim 1, wherein the covering is a nylon woven fabric coated with polyvinyl chloride.

15. A foldable dinghy as claimed in claim 1, wherein a suspended seat of flexible material is provided adjacent at least one end of the dinghy.

16. A foldable dinghy as claimed in claim 1, wherein the central uppermost portion of the frame at the stern of the dinghy is capable of supporting an outboard motor.

17. A foldable dinghy comprising a frame and a covering of flexible waterproof material attached to said frame, said frame comprising a plurality of longitudinal members each formed in a U shape;

end attachment means for pivotally coupling said members together so that said members are pivotable between a first folded position in which the members lie next to each other in substantially parallel relationship and a second deployed position in which said members define the hull frame of the erected dinghy;

each of said longitudinal members further comprising first and second hinge means for dividing said member into a central portion and two end portions, said end portions being swingable toward said central portion and each other;

a transverse foldable member extending between the central portions of at least two of said longitudinal members, said transverse member being movable between an extended position when said longitudinal members are deployed and said dinghy is erected, and a folded position in which said longitudinal members are pivoted to said first folded position; and means for releasably locking said transverse member in said extended position, the end portions of said longitudinal members being swingable toward each other only when said transverse member is in said folded position.

* * * * *